US010760149B2

(12) United States Patent
Song et al.

(10) Patent No.: US 10,760,149 B2
(45) Date of Patent: Sep. 1, 2020

(54) HIGHLY CORROSION-RESISTANT, HIGH STRENGTH, A1-CONTAINING WEATHERING STEEL PLATE AND PROCESS OF MANUFACTURING SAME

(71) Applicant: BAOSHAN IRON & STEEL CO., LTD., Shanghai (CN)

(72) Inventors: Fengming Song, Shanghai (CN); Donghui Wen, Shanghai (CN); Zigang Li, Shanghai (CN); Xiaoping Hu, Shanghai (CN); Ana Yang, Shanghai (CN); Jianye Li, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 0 days.

(21) Appl. No.: 14/762,592

(22) PCT Filed: Dec. 24, 2013

(86) PCT No.: PCT/CN2013/090274
§ 371 (c)(1),
(2) Date: Jul. 22, 2015

(87) PCT Pub. No.: WO2014/114160
PCT Pub. Date: Jul. 31, 2014

(65) Prior Publication Data

US 2015/0354041 A1 Dec. 10, 2015

(30) Foreign Application Priority Data

Jan. 24, 2013 (CN) ..... 2013 1 0026111

(51) Int. Cl.
*C22C 33/04* (2006.01)
*C21D 8/02* (2006.01)
(Continued)

(52) U.S. Cl.
CPC ..... *C22C 33/04* (2013.01); *B22D 11/00* (2013.01); *C21D 6/005* (2013.01); *C21D 6/008* (2013.01);
(Continued)

(58) Field of Classification Search
CPC ..... C22C 38/54; C22C 38/50; C22C 38/48; C22C 38/46; C22C 38/44; C22C 38/06;
(Continued)

(56) References Cited

U.S. PATENT DOCUMENTS 8,821,653 B2 * 9/2014 Anelli ..... C21D 1/18 138/177
2010/0266440 A1 10/2010 Fagot
(Continued)

FOREIGN PATENT DOCUMENTS

CN 101033520 A 9/2007
CN 101994064 A 3/2011
(Continued)

OTHER PUBLICATIONS

Office Action (including English translation) issued in corresponding Chinese Patent Application No. 201310026111.5, dated Sep. 3, 2014, 14 pages.
(Continued)

*Primary Examiner* — Colleen P Dunn
*Assistant Examiner* — Michael J Kachmarik
(74) *Attorney, Agent, or Firm* — Quarles & Brady LLP

(57) ABSTRACT

The invention provides a highly corrosion-resistant, high strength, Al-containing weathering steel plate, wherein the chemical composition comprises in weight percentages (wt %) of: C: 0.02-0.07%, Si: 0.2-1.0%, Mn: 0.2-2.2%, P≤0.01%, S≤0.006%, Cu: 0.2-0.5%, Cr: 0.5-3.5%, Ni: 0.2-1.2%, Al: 0.4-4.0%, N≤0.005%; selectively added one or more of Nb: 0.01-0.06%, Ti: 0.01-0.10%, V: 0.02-0.10%; the
(Continued)

balance of Fe and unavoidable impurities, wherein Al/Cr is 0.5-8.0. The steel plate has a yield strength of 350-500 MPa, an elongation of 20% or more, a relative corrosion rate of 27% or less and a good impact toughness and a low yield ratio. The present application also provides a method for manufacturing the weathering steel plate.

4 Claims, 1 Drawing Sheet

(51) Int. Cl.

| | |
|---|---|
| ***C21D 6/00*** | (2006.01) |
| ***B22D 11/00*** | (2006.01) |
| ***C22C 38/42*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/46*** | (2006.01) |
| ***C22C 38/48*** | (2006.01) |
| ***C22C 38/50*** | (2006.01) |
| ***C21D 9/46*** | (2006.01) |

(52) U.S. Cl.
CPC ..... *C21D 8/021* (2013.01); *C21D 8/0226* (2013.01); *C21D 8/0263* (2013.01); *C22C 38/001* (2013.01); *C22C 38/02* (2013.01); *C22C 38/04* (2013.01); *C22C 38/06* (2013.01); *C22C 38/42* (2013.01); *C22C 38/46* (2013.01); *C22C 38/48* (2013.01); *C22C 38/50* (2013.01); *C22C 38/58* (2013.01); *C21D 6/004* (2013.01); *C21D 9/46* (2013.01); *C21D 2211/002* (2013.01); *C21D 2211/005* (2013.01)

(58) Field of Classification Search
CPC ..... C22C 38/04; C22C 38/02; C22C 38/002; C22C 38/001; C21D 8/0221; C21D 8/0263; C21D 6/004; C21D 6/005; C21D 6/008
See application file for complete search history.

(56) References Cited

U.S. PATENT DOCUMENTS

| | | | | |
|---|---|---|---|---|
| 2013/0078135 | A1* | 3/2013 | Antonissen | C22C 38/02 420/87 |
| 2013/0319582 | A1* | 12/2013 | Yokoi | C21D 8/02 148/602 |
| 2014/0216609 | A1 | 8/2014 | Nakata et al. | |
| 2014/0299237 | A1* | 10/2014 | Somani | C21D 1/18 148/602 |

FOREIGN PATENT DOCUMENTS

| | | | | |
|---|---|---|---|---|
| CN | 102127717 | A | 7/2011 | |
| CN | 102168229 | A | 8/2011 | |
| CN | 102650015 | A | 8/2012 | |
| CN | 103074548 | A | 5/2013 | |
| JP | H0873933 | A | 3/1996 | |
| JP | H09176790 | A | 7/1997 | |
| JP | H11-172368 | A | 6/1999 | |
| JP | 2002266049 | A | 9/2002 | |
| JP | 2006118011 | A | 5/2006 | |
| WO | WO-03010351 | A1 * | 2/2003 | C22C 38/02 |
| WO | WO-2011120550 | A1 * | 10/2011 | C22C 38/02 |

OTHER PUBLICATIONS

PCT International Search Report, PCT/CN2013/090274, dated Apr. 3, 2014, 8 pages.
Japanese Patent Office, Notification of Reasons for Refusal (including English machine translation) issued in corresponding Japanese Patent Application No. 2015-554025, dated Nov. 28, 2017, 16 pages.
Korean Intellectual Propery Office, Notice of Preliminary Rejection, Application No. 10-2015-7022772, dated Apr. 21, 2020, 10 pages.

* cited by examiner

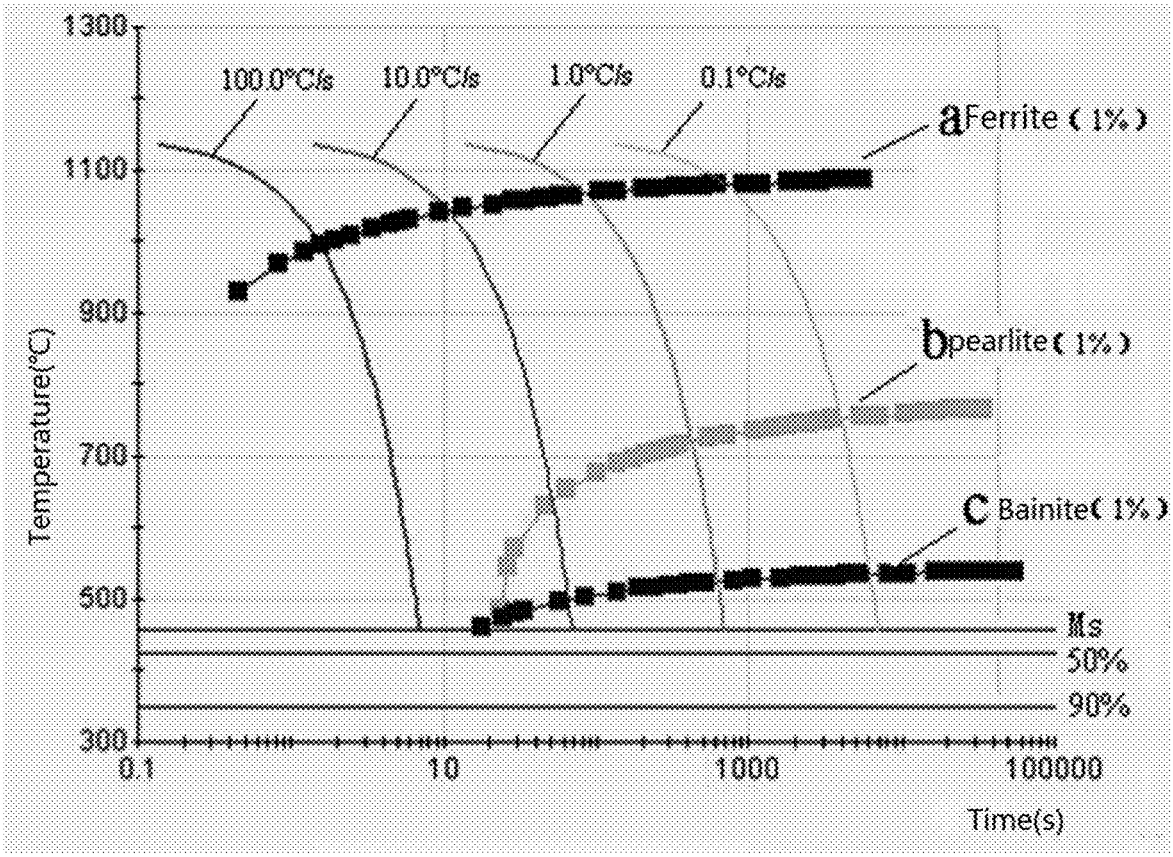
1300
1100
900
700
500
300
Temperature(°C)
100.0°C/s
10.0°C/s
1.0°C/s
0.1°C/s
aFerrite ( 1% )
bpearlite ( 1% )
c Bainite ( 1% )
Ms
50%
90%
0.1
10
1000
100000
Time(s)

HIGHLY CORROSION-RESISTANT, HIGH STRENGTH, A1-CONTAINING WEATHERING STEEL PLATE AND PROCESS OF MANUFACTURING SAME

CROSS-REFERENCE TO RELATED APPLICATIONS

This application represents the national stage entry of PCT International Application No. PCT/CN2013/090274 filed Dec. 24, 2013, which claims priority of Chinese Patent Application No. 201310026111.5 filed Jan. 24, 2013, the disclosures of which are incorporated by reference here in their entirety for all purposes.

TECHNICAL FIELD

The invention relates to the field of weathering steel manufacture, particularly to a highly corrosion-resistant, high strength, Al-containing weathering steel plate and a process of manufacturing the same.

BACKGROUND ART

Weathering steel, also named atmospheric corrosion-resistant steel, is described in Chinese Patent CN1609257 titled "High Strength Weathering Steel With Acicular Structure And Process Of Producing Same", Chinese Patent CN1986864 titled "High Strength, Low Alloy, Atmospheric Corrosion-resistant Steel And Process Of Producing Same", Japanese Patent JP04235250A titled "High Corrosion Resistant Steel Sheet" and U.S. Pat. No. 6,315,946 titled "Ultra Low Carbon Bainitic Weathering Steel", etc. The steel in each of the above patents belongs to the type of traditional CORTEN steel family, and their compositional system belongs to Cu—P—Cr—Ni family or Cr—Mn—Cu family. Different structural morphologies are obtained under certain rolling process conditions by addition of other trace alloy elements, so as to achieve the desired mechanical properties and corrosion resistance. In terms of alloy composition, they are low Cr weathering steel having a Cr content of 0.7% or less and an Al content of no more than 0.1%.

However, the reliance on P, Re to improve corrosion resistance has the problems of phosphorus segregation, cracking, and difficulty in controlling the Re content. In order to further improve the atmospheric corrosion resistance, researchers turn to development of high-alloy type weathering steel by increasing the contents of other corrosion-resistant elements to a large degree. Examples include Japanese Patent JP01079346A titled "Marine Corrosion Resistant Steel", Japanese Patent JP05302148A titled "Highly Corrosion-resistant, Highly Magnetic Damping Alloy", Japanese Patent JP10025550A titled "Corrosion Resistant Steel", Japanese Patent JP2000336463 titled "Corrosion Resistant Steel In The Soil", and Japanese Patent JP2002285298 titled "Cr-containing Corrosion Resistant Steel For Building And Construction Structure".

The steel in each of the above five patents contains a relatively large amount of Al, Cr components, and achieves particular mechanical properties with the assistance of other alloy elements. The first two patents relate to high Al weathering steel, wherein the Al content in the steel of Patent JP01079346A is up to 7-20%, while the steel of Patent JP05302148A comprises Si, Cr at levels far higher than common weathering steel in addition to a high Al content. The other three patents relate to weathering steel of high Cr family in terms of compositional system, wherein the content of Cr is generally 7% or higher, mostly in the range of 9-14%. The steel of Patent JP10025550A even contains up to 0.45-0.65% C. In addition, the steel of the above patents also comprises various amounts of components Co, W, Mo, B, Zr, etc. High Al and Cr family weathering steel represented by the above patents comprises such high amounts of alloy components that steel-making and steel-rolling become more difficult in the production on the one hand, and the cost is increased greatly on the other.

The relative corrosion rate of the prior art weathering steel is generally not high when good mechanical properties are guaranteed. Furthermore, the comprehensive mechanical properties of some types of steel can not even be guaranteed; instead, only one mechanical property is superior. As such, the requirements of increased corrosion resistance of steel used for railway vehicles and the like can not be satisfied, leading to short service life and high maintenance cost.

SUMMARY

An object of the invention is to provide a highly corrosion-resistant, high strength, Al-containing weathering steel plate and a process of manufacturing the same in order to solve the above problems existing in the prior art. The highly corrosion-resistant, high strength, Al-containing weathering steel plate has a yield strength of 350-500 MPa, a relative corrosion rate of 27% or less, a Charpy impact energy of 60 J or more at −40° C., an elongation of 20% or more; and it is mainly used in railway vehicle manufacture industry, container manufacture industry, bridge engineering, outdoor gantries and like fields.

In order to achieve the above object, the invention employs the following technical solution:

A highly corrosion-resistant, high strength, Al-containing weathering steel plate, comprising the following chemical elements in weight percentages (wt %) of: C: 0.02-0.07%, Si: 0.2-1.0%, Mn: 0.2-2.2%, P≤0.01%, S≤0.006%, Cu: 0.2-0.5%, Cr: 0.5-3.5%, Ni: 0.2-1.2%, Al: 0.4-4.0%, N≤0.005%, the balance of Fe and unavoidable impurities, wherein Al/Cr is 0.5-8.0.

Furthermore, the highly corrosion-resistant, high strength, Al-containing weathering steel plate of the invention further comprises one or more of Nb, Ti and V, wherein Nb: 0.01-0.06%, Ti: 0.01-0.10%, V: 0.02-0.10%, based on weight percentage.

The highly corrosion-resistant, high strength, Al-containing weathering steel plate of the invention has a yield strength of 350-500 MPa, which meets the requirement of weathering steel for high strength. Its atmospheric corrosion resistance relative to Q345B, measured as a relative corrosion rate which is as low as 27% or less, is far less than the regulative level of the atmospheric corrosion rate of common weathering steel relative to Q345B which is currently required to be no more than 55%. That is, the atmospheric corrosion resistance is doubled on the current basis. The highly corrosion-resistant, high strength, Al-containing weathering steel plate of the invention has a Charpy impact energy of 60 J or more at −40° C., and an elongation of 20% or more.

When used in atmospheric environment, the various alloy elements in the weathering steel interact with each other to form on the surface a dense rust layer comprising α-FeOOH as the major component, wherein the rust layer is thermodynamically stable and does not take part in the cathode reduction process during the electrochemical corrosion of the steel. The enrichment of elements such as copper, chromium and the like in the rust layer allows the rust layer to acquire ion selective permeation behavior which improves the atmospheric corrosion resistance of the steel significantly. As such, according to the principle that the interaction of the main corrosion-resistant alloy elements may improve corrosion resistance, an atmospheric corrosion resistant steel based on an Al—Cr compositional system is designed in the invention by coordinating the Al and Cr elements to control the Al/Cr ratio in the range of 0.5-8.0 and coordinating other alloy elements suitably, wherein the steel has a yield strength of 350-500 MPa which meets the requirement of weathering steel for high strength. When atmospheric corrosion resistance relative to Q345B steel is concerned, the relative corrosion rate of the steel of the inventive type is lowered to 27% or less, far less than the specified level of the corrosion rate of traditional high weathering steel relative to Q345B steel, i.e. no more than 55%. That is, the atmospheric corrosion resistance is doubled. While the good mechanical properties are guaranteed, the relative corrosion rate of the steel of the inventive type is lowered by half, such that the requirements of increased corrosion resistance of steel used for railway vehicles and the like are satisfied, leading to extended service life and reduced maintenance cost. Meanwhile, when the rolling temperature is controlled appropriately and a suitable cooling rate is employed as an auxiliary means on the basis of the current common continuously hot-rolled weathering steel, the steel of the inventive type not only acquires excellent comprehensive properties, but also can be put into large-scale industrial production. Moreover, Al follows oxygen and silicon closely as the third richest element in the earth's crust and its reserve is abundant. Selection of Al as the principal corrosion resistant element reduces consumption of precious rare resources and thus has a resource-saving effect.

In the compositional design of the highly corrosion-resistant, high strength, Al-containing weathering steel plate of the invention:

Al: Al is generally added into steel as a deoxidant in the process of steel making. At the same time, a trace amount of Al helps refine grains to improve the obdurability of a steel material. Meanwhile, Al is well resistant to oxidation. When it is exposed to air, a corrosion resistant oxide layer is formed on the surface. Addition of a suitable amount of Al in low carbon steel may improve the atmospheric corrosion resistance behavior of the steel. After addition of Al, the corrosion potential of the steel is increased. Meanwhile, Al and O (oxygen) are able to form a dense $Al_2O_3$ thin film on the surface. The thin film comprises such phases as $\alpha$-$Al_2O_3$, $AlFeO_3$, $AlFe_3$ and other substances which have good corrosion resistance, such that the corrosion resistance of the steel is improved. However, an unduly high amount of Al will increase the brittleness of the ferrite in the steel, leading to decreased toughness of the steel. Therefore, the content of Al is controlled in the range of 0.4-4%.

Cr: Cr has a remarkable effect of improving the passivation ability of steel, and can promote formation of a dense passivated film or protective rust layer on the steel surface. The enrichment of Cr in the rust layer can improve selective permeation of corrosive medium through the rust layer effectively. At the same time, addition of Cr in Al-containing steel may improve plasticity and toughness effectively. Moreover, the coordination of Cr and Al improves the atmospheric corrosion resistance of the steel significantly. For certain amounts of Al and Cr, as the Al/Cr ratio increases, the corrosion rate of the steel tends to decrease. However, an unduly high amount of Cr will add to the manufacture cost of steel plates on the one hand, and be undesirable for welding and toughness on the other. With the effect of varying amounts of Al, Cr on the properties of the steel plate taken into consideration comprehensively, the Al/Cr ratio is controlled in the range of 0.5-8.0.

C: As a principal strengthening element in steel, C can improve the strength of the steel plate significantly. However, a relatively large amount of C is undesirable for welding, toughness and plasticity. Low C design limits formation of pearlite structure and other carbides, guarantees that all the microstructures of the steel are homogeneous phase structures, avoids primary cell corrosion caused by a potential difference between different phases, and thus improves the corrosion resistance of the steel. Therefore, the C content is limited to 0.02-0.07%.

Si: The Si content is controlled in the range of 0.2-1.0%. Si, which has a relatively high solid solubility in steel, is able to increase the volume fraction of ferrite in the steel and refine grains. Hence, it is favorable for increasing toughness. However, an unduly high content of Si will degrade the weldability of the steel. Therefore, the upper limit is controlled at 1.0%.

Mn: Mn has a strong effect of solid solution strengthening. Meanwhile, it decreases the phase transformation temperature of the steel remarkably, and refines the microstructure of the steel. It is an important strengthening-and-toughening element. However, as an unduly high content of Mn will increase hardenability and deteriorate weldability and toughness in the weld heat-affected zone, it content is controlled in the range of 0.2-2.2%.

S: The presence of S will deteriorate the atmospheric corrosion resistance of steel, while P is able to improve the atmospheric corrosion resistance of steel. However, an unduly high content of P will decrease the toughness and plasticity of the steel. Meanwhile, segregation tends to occur in the presence of P. Therefore, extremely low contents of S, P are used in the design of the steel of the inventive type, with the contents controlled in the ranges of $P \leq 0.01\%$, $S \leq 0.006\%$.

Ni: Ni is an element that can both enhance the strength of steel and improve its toughness. Ni can also improve the hardenability of the steel, and prevent effectively check crack caused by red shortness of Cu. As Ni is a precious heavy metal element, which suggests the need of cost consideration, and an unduly high amount of Ni will enhance the adhesion of an oxide skin, leading to formation of hot rolling deficiencies in the surface if it is pressed into the steel, the Ni content is limited to 0.2-1.2%.

Cu: The function of Cu is basically the same as that of Ni. That is, it has the effect of solid solution strengthening and precipitation strengthening. When it is batched with Ni appropriately, the atmospheric corrosion resistance of steel may be improved significantly. However, an unduly high content of Cu is undesirable for welding, and tends to cause check crack during hot rolling. Therefore, the Cu content is controlled in the range of 0.20-0.50%.

Nb: Nb is an element that has a strong propensity to form carbides. The resultant fine carbide particles may refine the structure and have an effect of precipitation strengthening. As such, the strength of the steel plate is improved significantly. However, a relatively large amount of Nb is undesirable for welding. Therefore, Nb may be added selectively, and it is suggested that the content should not exceed 0.06%.

Ti and V: Addition of 0.01-0.10% Ti is mainly aimed to inhibit the growth of austenite grains during reheating of a slab, and the growth of ferrite grains during recrystallization controlled rolling to improve steel toughness. Addition of trace amounts of V or Ti in Al-containing low carbon steel may decrease the corrosion rate obviously. Therefore, the amount of V added selectively is controlled in the range of 0.02-0.1%.

N: Al and N in steel tend to combine to form AlN, such that the quantity of nitrides in the steel is increased remarkably. When present independently in the steel as a non-metal inclusion, AlN may break the consistency of the steel matrix. Particularly, when AlN features large quantity and aggregated distribution, its damage is even worse. Therefore, the N content must be controlled to be 0.0050% or less.

In addition to the above control over the chemical composition of the steel according to the invention, another crucial technique of the invention relates to selection and control in the process flow for manufacturing the highly corrosion-resistant, high strength, Al-containing weathering steel plate. The basic process flow is as follows:

Smelting→external refining→continuous casting→slab reheating→controlled rolling→controlled cooling→coiling→finishing→delivery.

The process of manufacturing the highly corrosion-resistant, high strength, Al-containing weathering steel plate according to the invention comprises the following specific steps:

1) Smelting, external refining, continuous casting:

By smelting, external refining and casting, a slab is formed from the following chemical components in weight percentages (wt %): C: 0.02-0.07%, Si: 0.2-1.0%, Mn: 0.2-2.2%, P≤0.01%, S≤0.006%, Cu: 0.2-0.5%, Cr: 0.5-3.5%, Ni: 0.2-1.2%, Al: 0.4-4.0%, N≤0.005%, the balance of Fe and unavoidable impurities, wherein Al/Cr is 0.5-8.0.

Alternatively, the chemical composition of the molten steel further comprises one or more of Nb, Ti and V, wherein Nb: 0.01-0.06%, Ti: 0.01-0.10%, V: 0.02-0.10%, based on weight percentage.

2) Slab heating: the slab obtained in step 1) is heated at a temperature of 1220° C. or above;

3) Rolling: the rolling process is controlled by two stages of rough rolling and finish rolling, and the end rolling temperature of the finish rolling is 720-800° C.;

4) Cooling: the rolled steel plate is cooled at a cooling rate of 10-40° C./s;

5) Coiling, finishing: the steel plate is controlled to be coiled at a temperature in the range of 460-520° C., and then cooled to room temperature, followed by finishing to give the highly corrosion-resistant, high strength, Al-containing weathering steel plate.

The steel according to the invention comprises a relatively large amount of Al which is an element that promotes formation of ferrite. The continuous cooling curve (CCT curve) of the steel is shown by FIG. 1. As can be seen from FIG. 1, the austenization temperature of the steel is above 1150° C. With the dissolution behavior of carbonitrides of trace alloy elements in austenite and the growth behavior of austenite grains during heating taken into account comprehensively, particular emphasis is put on reheating of the steel blank at a temperature of 1220° C. or above and control over the rolling process by two stages according to the invention.

In order to obtain the desired properties of the steel according to the invention, the matrix structure of the steel must be controlled to be ferrite+bainite. As shown by the CCT curve, the steel according to the invention has a very wide ferrite zone. To obtain excellent comprehensive properties and ensure the effect of refining grains by recrystallization, the accumulative deformation at 950° C. or above is required to be ≥80%, and the end rolling temperature of the finish rolling is not lower than 750° C. (the end rolling temperature may be lowered appropriately in the case that the thickness of the final product is increased). To ensure the effect of refining grains by deformation, the end rolling temperature is controlled in the range of 720-800° C. If the end rolling temperature exceeds 800° C., the grain structure will grow quickly and be coarsened. If the temperature is too low, the rolling force will be too large and the energy consumption will be increased.

As can be seen from the continuous cooling curve, a structure of ferrite+bainite can be obtained when the cooling rate is 50° C./s or less. In view of the time of rapid cooling to refine the structure and finish phase transformation, the cooling rate must be controlled at 10° C./s or higher if substantial transformation of ferrite→bainite in a short time is desired. However, if the cooling rate is too high, the transformation point of the structure will be decreased, and the content of the ferrite structure in the steel will be rather low, leading to poor plasticity of the steel. Hence, the cooling rate is controlled to be 40° C./s or lower. Therefore, the post-rolling cooling rate for the steel of the invention is controlled in the range of 10-40° C./s.

The coiling temperature is determined according to the transformation point of the steel in combination with the structure of the steel plate. As shown by FIG. 1, the martensite transformation of the steel begins at a temperature of about 460° C. If the cooling stop temperature is lower than this temperature, a lot of martensite will form, which degrades the toughness and plasticity of the steel material badly despite that the strength is improved. If the cooling stop temperature exceeds 520° C., the ferrite+bainite structure can not be obtained. Therefore, coiling of the steel plate must be controlled to be performed at a temperature in the range of 460-520° C., followed by cooling to room temperature.

The chemical composition and mechanical properties of the highly corrosion-resistant, high strength, Al-containing weathering steel plate are shown in Table 1 and compared with the chemical compositions and properties of similar steel types (see Table 1).

Comparative Patent 1: Chinese Patent CN101376953A, which features an ultra-low carbon content along with an extremely low Mn content and certain amounts of N, Ca.

Comparative Patent 2: Japanese Patent JP2002363704, which requires 3-20% Mn and selective addition of one or more of Cu, Ni, Mo, Nb, V, Ti, Zr and Mg+Ca, etc.

Comparative Patent 3: Japanese Patent JP2002285298, which requires addition of N and 4-9% Cr, as well as selective addition of one or more of Cu, Ni, Mo, Nb, V, Ti, Ca, Mg, Re, etc.

TABLE 1

Comparison of compositions and mechanical properties between the inventive steel and the comparative steel

| Item | | The Invention | Comparative Patent 1 | Comparative Patent 2 | Comparative Patent 3 |
|---|---|---|---|---|---|
| Chemical Composition (wt %) | C | 0.02-0.07 | 0.002-0.005 | ≤0.03 | ≤0.03 |
| | Si | 0.2-1.0 | 0.20-0.40 | 0.01-3.0 | 0.01-3.0 |
| | Mn | 0.2-2.2 | 0.01-0.05 | 3-20 | 0.10-3 |
| | P | ≤0.01 | ≤0.02 | ≤0.03 | ≤0.03 |
| | S | ≤0.006 | ≤0.008 | ≤0.010 | ≤0.01 |
| | Al | 0.4-4 | 0.01-0.05 | 0.8-10 | 0.1-5 |
| | Ti | (0.01-0.10) | ≤0.03 | 0.005-0.05 | (0.005-0.03) |
| | Cu | 0.2-0.5 | 0.20-0.40 | 0.1-5 | 0.05-10 |
| | Cr | 0.5-3.5 | 4.50-5.50 | 0.5-9.9 | 4-9 |
| | Ni | 0.2-1.2 | ≤0.40 | 0.1-5 | 0.05-10 |
| | Nb | (0.01-0.06) | — | 0.005-0.05 | 0.005-0.05 |
| | V | (0.02-0.1) | — | 0.01-0.1 | 0.005-0.1 |
| | Zr | — | — | 0.005-0.05 | — |

TABLE 1-continued

Comparison of compositions and mechanical properties between the inventive steel and the comparative steel

| Item | The Invention | Comparative Patent 1 | Comparative Patent 2 | Comparative Patent 3 |
|---|---|---|---|---|
| Mg | — | — | 0.0005-0.5 (Ca + Mg) | 0.0005-0.05 |
| Mo | — | — | | 0.01-1 |
| N | ≤0.005 | 0.001-0.06 | ≤0.01 | 0.02 |
| Ca | — | 0.001-0.006 | — | 0.01-1 |
| RE | — | — | — | 0.01-0.1 |
| Yield strength/MPa | 350-500 | ≥700 | 250-650 | — |
| Tensile strength/MPa | ≥450 | — | 345-780 | — |
| Yield ratio/% | ≤80 | — | — | — |
| Elongation/% | ≥20 | ≥20 | — | — |
| Charpy V impact energy value/J (−40° C.) | ≥60 | — | — | — |

As seen from the comparison in Table 1:

Comparative Patents 1 and 2 both disclose highly corrosion-resistant weathering steel, wherein the steel disclosed by Comparative Patent 1 has a yield strength of 700 MPa or more, and requires an ultra-low carbon content (C: 0.002%-0.005%) as well as 0.05% or less Mn, Al, leading to increased difficulty in steel making. Meanwhile, the Cr content (4.5-5.5%) is also higher than that required in the present embodiment (0.5-3.5%), and addition of a certain amount of N is required. Comparative Patent 1 is apparently different from the invention.

In the steel disclosed by Comparative Patent 2, the ranges of Cr and Al contents are still wider, wherein the upper limits are far beyond the Cr and Al contents required by the steel of the invention. This would bring about tremendous negative effect to the invention. For example, excessive Al results in decreased steel toughness by increasing the brittleness of ferrite in the steel. Excessive Cr is unfavorable for both welding and toughness and brings undesirable effect on the ratio of Cr and Al, thus not meeting the requirement of compositional design according to the invention. Particularly, the Mn content is required to be 3-20%, whereas the Mn content of the inventive steel is 2.2% or lower. The former is apparently higher than the Mn content of the inventive steel. Simultaneous addition of Mo, Zr and like alloy elements is also required. The steel disclosed by Comparative Patent 2 has a yield strength in the range of 250 MPa-650 MPa, which may be as low as 250 MPa and covers a wide range. Furthermore, other comprehensive performance data, such as corrosion resistance, yield ratio, elongation, Charpy impact energy at −40° C., etc., are not available. Thus, Comparative Patents 1 and 2 are both obviously different from the present invention.

The Cr content of the steel disclosed by Comparative Patent 3 is 4-9%, far higher than the Cr content of the inventive steel in the range of 0.5-3.5%. In addition, Comparative Patent 3 requires up to 10% Cu and Ni. Furthermore, the steel disclosed by Comparative Patent 3 requires 0.02% N, 0.01-1.0% Mo, 0.005-0.05% Mg, 0.001-0.1% rare earth and other elements. The addition of these elements increases the manufacture cost and difficulty on the one hand, and it is also unfavorable for welding and toughness of the steel plate on the other. In contrast, no elements in the above ranges are required in the invention.

Additionally, the requirements of the mechanical properties of the inventive steel are different from those of the various steel types in the comparative patents. The highly corrosion-resistant, high strength, Al-containing weathering steel plate according to the invention requires a yield strength of 350-500 MPa. In contrast, the yield strength of the steel disclosed by Comparative Patent 1 is 700 MPa or higher; and the steel strength of Comparative Patent 2 varies in a wide range. Moreover, no performance data related with low temperature toughness are available for the steel disclosed by Comparative Patents 1-3.

Compared with the prior art, the highly corrosion-resistant, high strength, Al-containing weathering steel plate according to the invention has the following advantages and beneficial effects:

1. The inventive steel has a yield strength of 350 MPa-500 MPa, and thus belongs to high strength weathering steel which meets the requirement of a vehicle for reduced deadweight of its members.

2. Addition of suitable amounts of Al and Cr ensures that the inventive steel has good atmospheric corrosion resistance. Particularly, owing to the control over the ratio of Al and Cr, while good mechanical properties are guaranteed, the atmospheric corrosion resistance of the inventive steel is increased by 100% or more as compared with the traditional weathering steel. Hence, the inventive steel may be used instead of the traditional high strength weathering steel in railway vehicles, containers, bridges, outdoor gantries and like fields, with decreased use and maintenance costs.

3. The inventive steel has good cold bendability and low temperature toughness. Its impact energy at −40° C. is 60 J or more. Even the impact energy of a half sample is not lower than 40 J, even higher than 60 J in some cases (see Table 3).

4. The inventive steel is manufactured using a controlled-rolling & controlled-cooling process (TMCP). After rolling, no thermal treatment is needed. Hence, the steel may be delivered in a hot rolling state, which ensures delivery period effectively and reduces production cost.

DESCRIPTION OF DRAWING

FIG. 1 shows a CCT curve of the highly corrosion-resistant, high strength, Al-containing weathering steel plate according to the invention (by calculation).

DETAILED DESCRIPTION OF THE INVENTION

The invention will be further illustrated with reference to the following specific Examples.

Following the requirement of the highly corrosion-resistant, high strength, Al-containing weathering steel plate according to the invention for chemical composition in weight percentages (see Table 2 for the chemical formulations), the inventive steel was smelted in a 500 kg lab vacuum induction furnace. The temperature for heating a steel blank was 1220° C. or higher; the end rolling temperature was 720-800° C.; and the coiling temperature was 460-520° C., followed by air cooling to room temperature. See Table 3 for the related mechanical properties of the steel Examples.

TABLE 2

Unit: weight percent

| Ex. | C | Si | Mn | P | S | Al | Cu | Ni | Cr | Nb | V | Ti | N | Al/Cr |
|---|---|---|---|---|---|---|---|---|---|---|---|---|---|---|
| A | 0.021 | 0.20 | 0.40 | 0.0090 | 0.0028 | 0.7 | 0.25 | 0.27 | 1.28 | | 0.025 | | 0.0031 | 0.55 |
| B | 0.022 | 0.95 | 0.30 | 0.0024 | 0.0022 | 3.0 | 0.34 | 0.24 | 2.4 | | | 0.010 | 0.0038 | 1.25 |
| C | 0.032 | 0.15 | 0.77 | 0.0087 | 0.0017 | 3.0 | 0.45 | 0.33 | 0.8 | 0.020 | | 0.018 | 0.0029 | 3.75 |
| D | 0.064 | 0.30 | 0.68 | 0.0090 | 0.0014 | 1.7 | 0.31 | 0.35 | 3.4 | 0.018 | 0.090 | | 0.0026 | 0.50 |
| E | 0.038 | 0.50 | 0.97 | 0.0015 | 0.0016 | 3.2 | 0.31 | 0.47 | 0.7 | 0.030 | | 0.09 | 0.0021 | 4.57 |
| F | 0.024 | 0.10 | 1.12 | 0.0023 | 0.0024 | 2.8 | 0.34 | 0.58 | 0.5 | 0.040 | | | 0.0035 | 5.60 |
| G | 0.053 | 0.25 | 2.15 | 0.0074 | 0.0031 | 3.5 | 0.28 | 1.15 | 1.5 | 0.060 | | | 0.0043 | 2.33 |

TABLE 3

| Ex. | Gauge/ mm | Heating Temperature/ ° C. | End rolling temperature/ ° C. | Coiling temperature/ ° C. | Yield Strength Rp0.2/MPa | Tensile strength Rm/MPa | Yield Ratio YR/% | Elongation A/% | −40° C. Impact Energy AKv/J |
|---|---|---|---|---|---|---|---|---|---|
| A | 6 | 1240 | 800 | 520 | 493 | 625 | 79 | 21.0 | 68 |
| B1 | 6 | 1240 | 780 | 510 | 430 | 585 | 73.5 | 21.0 | 63 |
| B2 | 10 | 1240 | 760 | 490 | 412 | 545 | 75.6 | 22.3 | 75 |
| C | 8 | 1240 | 780 | 520 | 383 | 485 | 78.9 | 26.8 | 47 |
| D1 | 8 | 1250 | 740 | 460 | 548 | 683 | 80 | 20.0 | 44 |
| D2 | 12 | 1250 | 720 | 460 | 511 | 635 | 80 | 20.8 | 84 |
| E | 12 | 1250 | 780 | 490 | 363 | 490 | 74.1 | 22.8 | 84 |
| F | 12 | 1250 | 760 | 490 | 398 | 513 | 77.6 | 23.5 | 89 |
| G | 16 | 1250 | 720 | 460 | 475 | 610 | 77.9 | 20.3 | 85 |

Note:

1) B1 and B2 were manufactured from molten steel having the chemical composition of B in Table 2; D1 and D2 were manufactured from molten steel having the chemical composition of D in Table 2.

2) The impact energy at −40° C. for steel plates A, B1, C, D1 having a gauge less than 10 mm was half-sample impact energy; the impact energy at −40° C. for the rest steel plates was full-sample impact energy.

Using common carbon steel Q345B and high strength weathering steel Q450NQR1 as comparative samples, "Periodical Immersion Corrosion Test Method For Railway Weathering Steel" (TB/T2375-93) was followed to conduct 72 h periodical immersion cyclic corrosion tests. Average corrosion rates were obtained by calculating the corrosion-induced weight loss per unit area of the samples, and relative corrosion rates were further obtained. The atmospheric corrosion resistance parameters of 9 Example steel types (A-G) and the comparative steel types are shown in Table 4.

TABLE 4

Atmospheric corrosion resistance of 9 Example steel types

| Steel Type | Average Corrosion Rate ($mg/cm^2 \cdot h$) | Relative Corrosion Rate (%) |
|---|---|---|
| A | 0.1342 | 25.8 |
| B1 | 0.0657 | 12.6 |
| B2 | 0.0650 | 12.5 |
| C | 0.0871 | 16.8 |
| D1 | 0.1315 | 25.3 |
| D2 | 0.1310 | 25.1 |
| E | 0.0815 | 15.7 |
| F | 0.1278 | 24.6 |
| G | 0.1035 | 19.9 |
| Q345B | 0.5194 | 100.0 |
| Q450NQR1 | 0.2018 | 38.9 |

The Example steel obtained according to the compositional design and controlled rolling process for the highly corrosion-resistant, high strength, Al-containing weathering steel plate according to the invention has a yield strength of 350-500 MPa, an elongation of 20% or more, and a good impact toughness and a low yield ratio. The comparing results of the atmospheric corrosion resistance also indicate that the atmospheric corrosion resistance of the inventive steel is increased by 100% or more as compared with the performance requirement of the traditional high strength weathering steel (relative corrosion rate ≤55%), and the relative corrosion rate is 27% or less. Therefore, the highly corrosion-resistant, high strength, Al-containing weathering steel plate according to the invention can replace the traditional weathering steel and the currently existing high strength weathering steel fully, and may be used widely in atmospheric environment to meet the requirements of railway vehicles, container manufacture, bridges, outdoor gantries and like fields.

What is claimed is:

1. A highly corrosion-resistant, high strength, Al-containing weathering steel plate, comprising the following chemical elements in weight percentages (wt %) of: C: 0.02-0.07%, Si: 0.2-1.0%, Mn: 0.2-2%, P≤0.01%, S≤0.006%, Cu: 0.2-0.5%, Cr: 0.7-2.4%, Ni: 0.2-1.2%, Al: 3.0-3.5%, N≤0.005%, the balance of Fe and unavoidable impurities, wherein Al/Cr is 1.25-4.75; and the steel plate has a yield strength of 350-500 MPa, a relative corrosion rate of 19.9% or less, a Charpy full-sample impact energy of 60 J or more at −40° C., and an elongation of 20% or more.

2. The highly corrosion-resistant, high strength, Al-containing weathering steel plate of claim 1, further comprising one or more of Nb, Ti and V, wherein Nb: 0.01-0.06%, Ti: 0.01-0.10%, V: 0.02-0.10%, based on weight percentage.

3. A process of manufacturing a highly corrosion-resistant, high strength, Al-containing weathering steel plate, comprising the following steps:

1) Smelting, external refining, continuous casting:

By smelting, external refining and continuous casting, a slab is formed from the following chemical components in weight percentages (wt %): C: 0.02-0.07%, Si:

0.2-1.0%, Mn: 0.2-2.2%, P≤0.01%, S≤0.006%, Cu: 0.2-0.5%, Cr: 0.7-2.4%, Ni: 0.2-1.2%, Al: 3.0-3.5%, N≤0.005%, the balance of Fe and unavoidable impurities, wherein Al/Cr is 1.25-4.75;

2) Slab heating: the slab obtained in step 1) is heated at a temperature of 1220° C. or above;

3) Rolling: the rolling process is controlled by two stages of rough rolling and finish rolling, and the end rolling temperature of the finish rolling is 720-800° C.;

4) Cooling: the rolled steel plate is cooled at a cooling rate of 10-40° C./s;

5) Coiling, finishing: the steel plate is controlled to be coiled at a temperature in the range of 460–520° C., and then cooled to room temperature, followed by finishing to give the highly corrosion-resistant, high strength, Al-containing weathering steel plate wherein the steel plate obtained has a yield strength of 350-500 Mpa, a relative corrosion rate of 19.9% or less, a Charpy full-sample impact energy of 60 J or more at −40° C., and an elongation of 20% or more.

4. The process of manufacturing a highly corrosion-resistant, high strength, Al-containing weathering steel plate according to claim 3, wherein the chemical components of the molten steel further comprises one or more of Nb, Ti and V, wherein Nb: 0.01-0.06%, Ti: 0.01-0.10%, V: 0.02-0.10%, based on weight percentage.

* * * * *